US009493320B2

(12) United States Patent
Yang et al.

(10) Patent No.: US 9,493,320 B2
(45) Date of Patent: Nov. 15, 2016

(54) FEEDING DEVICE

(71) Applicants: FU DING ELECTRICAL TECHNOLOGY (JIASHAN) CO., LTD., Zhejiang (CN); HON HAI PRECISION INDUSTRY CO., LTD., New Taipei (TW)

(72) Inventors: Ming-Lu Yang, New Taipei (TW); Wei-Zhong Dai, Jiashan (CN); Chao Shen, Jiashan (CN)

(73) Assignees: FU DING ELECTRONICAL TECHNOLOGY (JIASHAN) CO., LTD., Zhejiang (CN); HON HAI PRECISION INDUSTRY CO., LTD., New Taipei (TW)

( * ) Notice: Subject to any disclaimer, the term of this patent is extended or adjusted under 35 U.S.C. 154(b) by 65 days.

(21) Appl. No.: 14/508,633

(22) Filed: Oct. 7, 2014

(65) Prior Publication Data

US 2015/0115094 A1 Apr. 30, 2015

(30) Foreign Application Priority Data

Oct. 30, 2013 (CN) ..... 2013 2 06733350 U

(51) Int. Cl.

| | |
|---|---|
| ***B65H 20/34*** | (2006.01) |
| ***B65H 23/188*** | (2006.01) |
| ***B65H 20/02*** | (2006.01) |
| ***B65H 16/06*** | (2006.01) |

(52) U.S. Cl.

CPC ..... *B65H 20/34* (2013.01); *B65H 16/06* (2013.01); *B65H 20/02* (2013.01); *B65H 23/1882* (2013.01); *B65H 2408/217* (2013.01); *B65H 2511/112* (2013.01); *B65H 2513/11* (2013.01); *B65H 2553/24* (2013.01); *B65H 2701/11332* (2013.01)

(58) Field of Classification Search

CPC ..... B65H 20/34; B65H 20/048; B65H 20/24; B65H 20/32; B65H 23/048; B65H 23/16; B65H 23/1882; B65H 2511/112; B65H 2408/217; B65H 2408/2171; B65H 2408/2174; B65H 2553/24

See application file for complete search history.

(56) References Cited

U.S. PATENT DOCUMENTS 5,582,339 A * 12/1996 Focke ..... B65B 41/12 226/118.2

* cited by examiner

*Primary Examiner* — Michael McCullough
(74) *Attorney, Agent, or Firm* — Zhigang Ma

(57) ABSTRACT

A feeding device in manufacturing which is configured to feed a carrier tape includes a transmission mechanism and a buffering mechanism. The transmission mechanism is configured to receive the carrier tape and transfer the carrier tape to the buffering mechanism. The buffering mechanism includes a slide assembly, a feeder assembly, and an inductor. The slidable feeder assembly is mounted to the slide assembly, and is configured to receive the carrier tape transferred from the transmission mechanism. The slide assembly moves the feeder assembly. The inductor is mounted to one side of the slide assembly, and senses distances from the feeder assembly, to control a feeding speed of the transmission mechanism.

12 Claims, 4 Drawing Sheets

FEEDING DEVICE

FIELD

The subject matter herein generally relates to feeding devices in manufacturing.

BACKGROUND

In practice, a carrier tape carrying productions or work-pieces transfers these objects from one machining station to another by at least one production line, and more and more feeding devices are employed in automated production lines. The feeding devices can feed the carrier tape to the production lines. The production lines can transmit the work-pieces to processing stations.

BRIEF DESCRIPTION OF THE DRAWINGS

Implementations of the present technology will now be described, by way of example only, with reference to the attached figures.

DETAILED DESCRIPTION

Figure 1:
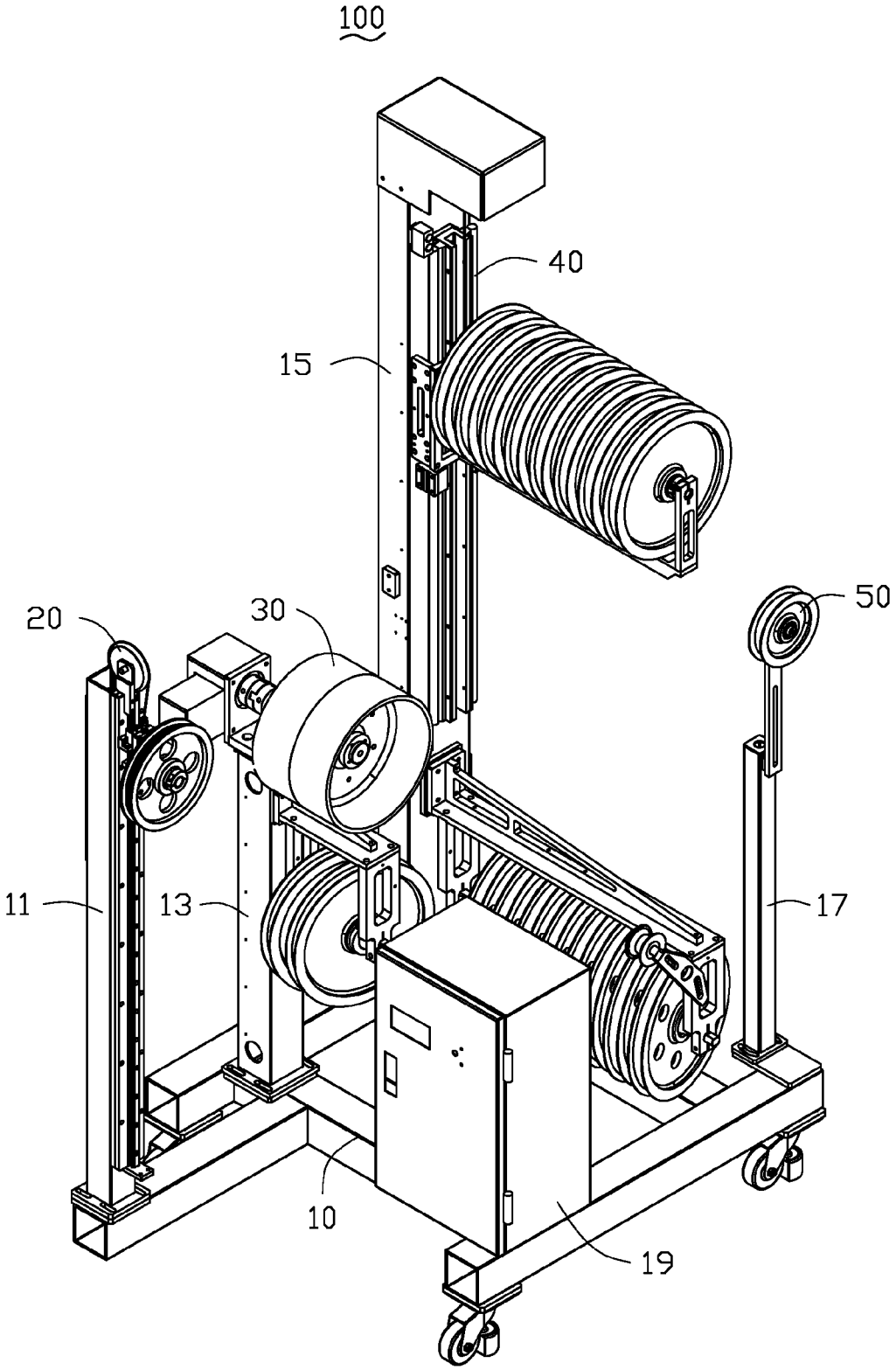
FIG. 1 is a perspective view of an embodiment of a feeding device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The term "comprising," when utilized, means "including, but not necessarily limited to"; it specifically indicates open-ended inclusion or membership in the so-described combination, group, series, and the like.

FIG. 1 illustrates an embodiment of a feeding device 100. The feeding device 100 can be configured to feed a carrier tape (not shown). The feeding device 100 can include a bracket 10, a fastening mechanism 20, a transmission mechanism 30; a buffering mechanism 40, and a discharging mechanism 50. The fastening mechanism 20 and the buffering mechanism 40 can be arranged at either side of the bracket 10. The transmission mechanism 30 can be arranged between the fastening mechanism 20 and the buffering mechanism 40. The discharging mechanism 50 can be mounted to the bracket 10, in a position relative to the buffering mechanism 40. The feeding device 100 can automatically transfer the carrier tape.

The bracket 10 can include a first column 11, a second column 13, a third column 15; a fourth column 17, and an electronic control box 19. The first column 11 can be hollow, and can be configured to mount the fastening mechanism 20. The second column 13 can be configured to mount the transmission mechanism 30. The third column 15 can be hollow, and can be configured to mount the buffering mechanism 40. The fourth column 17 can be configured to mount the discharging mechanism 50. The electronic control box 19 can be electrically connected to the transmission mechanism 30 and the buffering mechanism 40 to control the motions of the transmission mechanism 30 and the buffering mechanism 40.

The discharging mechanism 50 can be mounted to one end of the fourth column 17, and can be configured to receive the carrier tape transferred by the buffering mechanism 40 and transfer the carrier tape to a next machining station (not shown).

Figure 2:
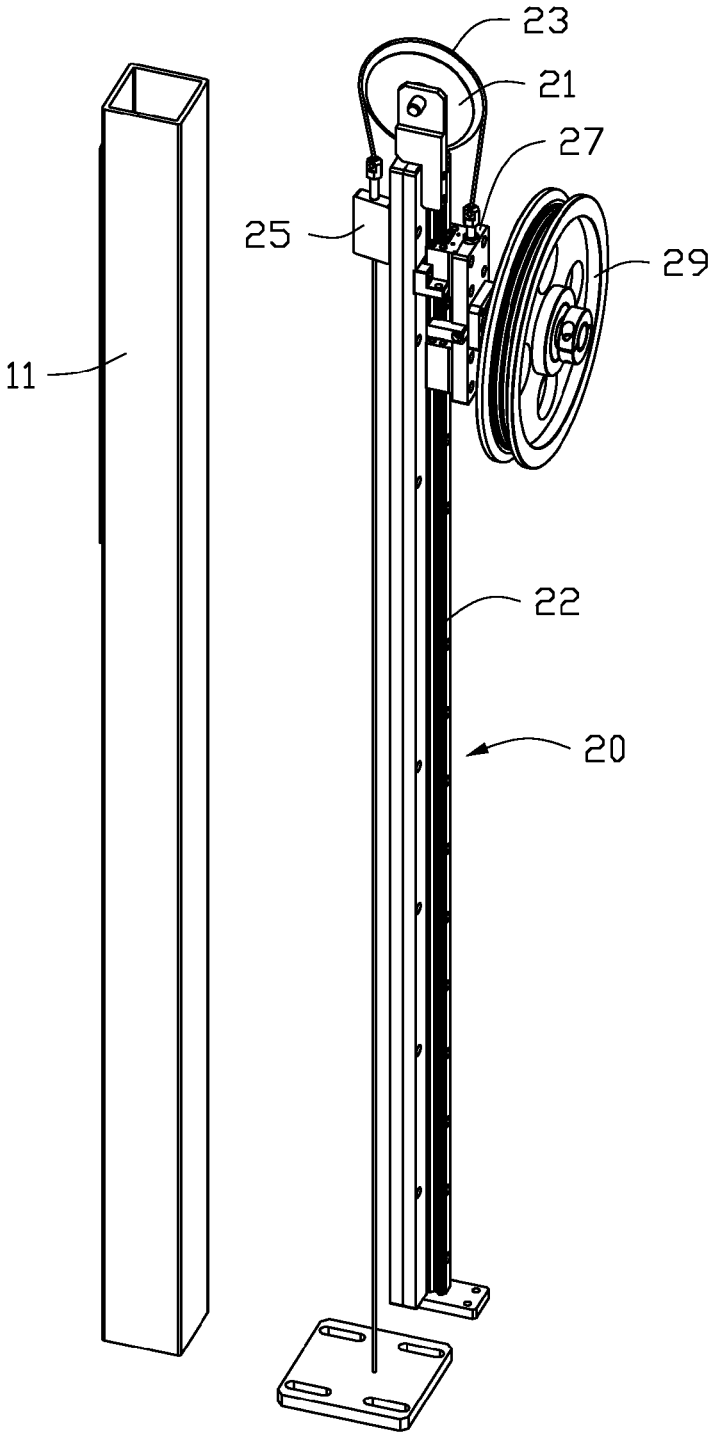
FIG. 2 is an enlarged view of a fastening mechanism of the feeding device of FIG. 1.

FIG. 2 illustrates that the fastening mechanism 20 can include a roller 21, a slide assembly 22, a rope 23, a weight member 25, a slide block 27, and a pressing wheel 29.

The fastening mechanism 20 can be configured to press the carrier tape, and can keep the carrier tape under tension. The roller 21 can be arranged at one end of the first column 11. The slide assembly 22 can be mounted to the first column 11, under the roller 21. The rope 23 can revolve the roller 21, and can be received in the first column 11. The weight member 25 can be connected to one end of the rope 23, and can be received in the first column 11. The slide block 27 can be mounted to the slide assembly 22, and can be connected to the other end of the rope 23. The pressing wheel 29 can be arranged to the slide block 27, and can be moved with the slide block 27. When the carrier tape is located under the pressing wheel 29, the slide block 27 and the pressing wheel 29 can be moved to a pre-determined position to press the carrier tape, by adjusting a weight of the weight member 25.

Figure 3:
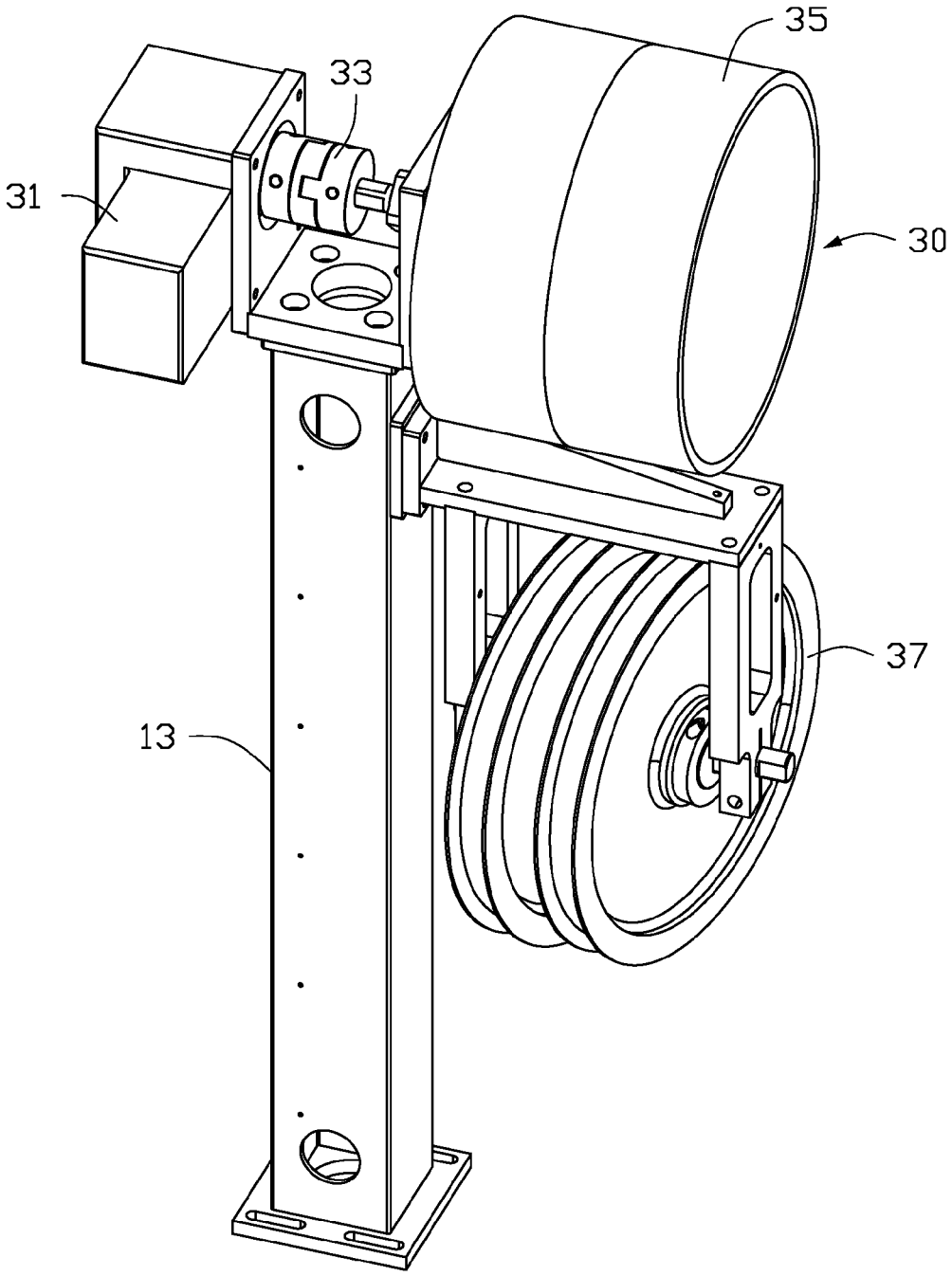
FIG. 3 is an enlarged view of a transmission mechanism of the feeding device of FIG. 1.

FIG. 3 illustrates that the transmission mechanism 30 can include a driver 31, a driving shaft 33, a driving wheel 35, and a feeding wheel 37. The transmission mechanism 30 can be configured to receive the carrier tape pressed by the fastening mechanism 20 (see FIG. 1) and transfer the carrier tape to the buffering mechanism 40.

One end of the driving shaft 33 can be connected to the driver 31, and the other end of the driving shaft 33 can engage to the driving wheel 35. When the driver 31 is rotated, the driving shaft 33 can be rotated, and the driving wheel 35 can be rotated to receive the carrier tape pressed by the fastening mechanism 20. The feeding wheel 37 can be mounted under the driving wheel 35 to receive the carrier tape from the driving wheel 35 and transfer the carrier tape to the buffering mechanism 40. When the carrier tape is presented to the driving wheel 35, the driving wheel 35 can be rotated by the driver 31 to tense the carrier tape and transfer the carrier tape to the feeding wheel 37. The feeding wheel 37 can transfer the carrier tape to the buffering mechanism 40.

Figure 4:
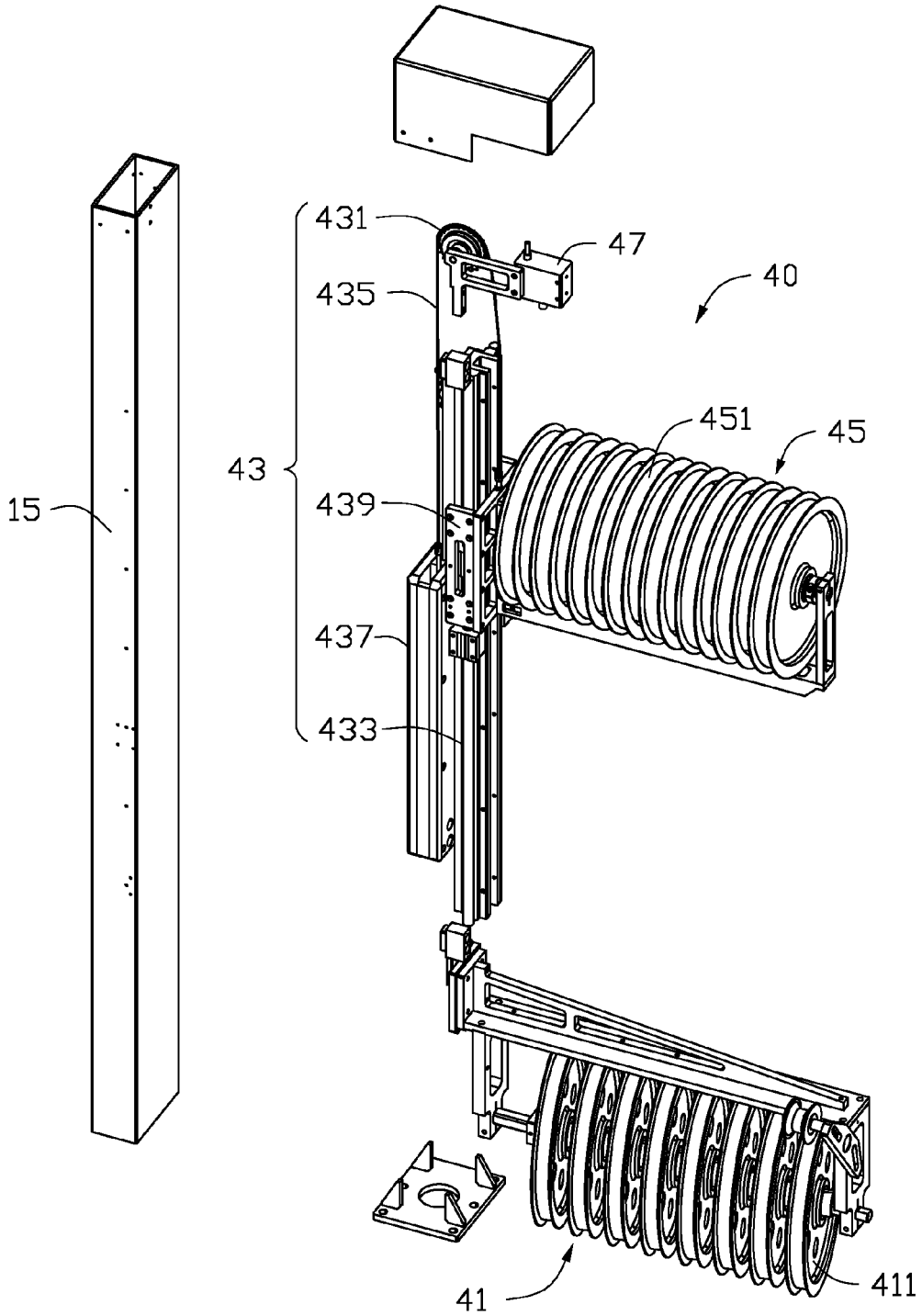
FIG. 4 is an enlarged view of a buffering mechanism of the feeding device of FIG. 1.

FIG. 4 illustrates that the buffering mechanism 40 can include a saving assembly 41, a slide assembly 43, a feeder assembly 45, and an inductor 47. The buffering mechanism 40 can be configured to receive the carrier tape transferred by the transmission mechanism 30 (see FIG. 1) and transfer the carrier tape to the discharging mechanism 50.

The saving assembly 41 can be mounted to the third column 15 adjacent to the feeding wheel 37 (see FIG. 3). The saving assembly 41 can include a plurality of saving wheels 411. The saving wheels 411 can be configured to receive the carrier tape transferred by the feeding wheel 37. The slide assembly 43 can be mounted under the saving assembly 41, and can include a gear 431, a guide rail 433, a connecting rope 435; a weight member 437, and a slide block 439. The gear 431 can be mounted to one end of the third column 15. The guide rail 433 can be mounted to the third column 15 under the gear 431. The connecting rope 435 can revolve the gear 431. The weight member 437 can be connected to one end of the connecting rope 435. The slide block 439 can be connected to the other end of the connecting rope 435, and can be mounted to the guide rail 433 to drive the motion of the feeder assembly 45.

The feeder assembly 45 can be mounted to the slide block 439, and can include a plurality of feeding wheels 451. The feeding wheels 451 can be configured to receive the carrier tape transferred by the saving wheels 411 and transfer the carrier tape to the discharging mechanism 50. The inductor 47 can be mounted adjacent to the gear 431. The inductor 47 can detect a distance between the feeder assembly 45 and the inductor 47, and can control the rotation speed of the driving wheel 35 (see FIG. 3) by the electronic control box 19 (see FIG. 1) to control a transferring speed of the carrier tape. The slide block 439 and the feeder assembly 45 can be disposed in a pre-determined position by adjusting a weight of the weight member 437.

In operation, the carrier tape transferred from a front machining station (not shown) can be passed through the fastening mechanism 20, the transmission mechanism 30, the buffering mechanism 40, and the discharging mechanism 50. Then, the carrier tape can be positioned at a feeding end of the next machining station. A position of the pressing wheel 29 can be adjusted to press the carrier tape (not shown), and can keep the carrier tape under tension. The feeding device 100 can be governed by the electronic control box 19. The driving wheel 35 can be rotated to transfer the carrier tape to the buffering mechanism 40. The saving wheels 411 can be rotated to transfer the carrier tape to the feeding wheels 451. The feeding wheels 451 can transfer the carrier tape to the discharging mechanism 50. Then, the carrier tape can be transferred to the next machining station (not shown). In the course of the transferring of the carrier tape, a pull from an output end of the front machining station can be equal to a pull from an input end of the next machining station, so the feeder assembly 45 can be located in a pre-determined position to continuously feed the carrier tape.

When the carrier tape of the front machining station has run through, the pull from the output end of the front machining station is lost, and the pull from an input end of the next machining station can form a component force in the vertical direction of the feeder assembly 45. By the component force in the vertical direction of the feeder assembly 45, the feeder assembly 45 and the slide block 439 can be moved along the guide rail 433 away from the inductor 47, and the weight member 437 can be moved up. The inductor 47 can sense a change in distance from the feeder assembly 45, and can send the information to the electronic control box 19. The electronic control box 19 can slow the feeder assembly 45 down to allow the front machining station to add the carrier tape. The added carrier tape can be connected to the previous carrier tape. Then, the output end of the front machining station can pull the carrier tape, and the pull of the feeder assembly 45 can be reduced. The feeder assembly 45 and the slide block 439 can be moved along the guide rail 433 toward the inductor 47 by a pull of the weight member 437. The inductor 47 can sense a change in distance from the feeder assembly 45, and can send the information to the electronic control box 19. The electronic control box 19 can speed the driving wheel 35 up to re-establish the transferring rate of the carrier tape. The feeding device 100 can continuously transfer the carrier tape.

The embodiments shown and described above are only examples. Many details are often found in the art such as the other features of a feeding device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A feeding device configured to feed a carrier tape, comprising:

a transmission mechanism;

a buffering mechanism having a slide assembly;

a feeder assembly slidably mounted to, and movable by, the slide assembly; and an inductor mounted to the slide assembly;

wherein, the carrier tape is received by the transmission mechanism and fed into the feeder assembly;

wherein, the inductor controls the speed of the transmission mechanism;

the feeding device further comprises a bracket and a fastening mechanism; and the fastening mechanism and the buffering mechanism are arranged to either side of the bracket, and the transmission mechanism is arranged between the fastening mechanism and the buffering mechanism;

the bracket comprises a first column, a second column, a third column, a fourth column, and an electronic control box;

the fastening mechanism is mounted to the first column, the transmission mechanism is mounted to the second column, and the buffering mechanism is mounted to the third column; and the electronic control box is electrically connected to the transmission mechanism and the buffering mechanism.

2. The feeding device as claimed in claim 1, wherein:

the fastening mechanism comprises a roller, a slide assembly, a rope; a weight member, a slide block, and a pressing wheel; and the fastening mechanism is configured to press the carrier tape and transfer the carrier tape to the transmission mechanism.

3. The feeding device as claimed in claim 2, wherein:

the roller is mounted to one side of the first column;

the slide assembly is mounted to the first column under the roller;

the rope revolves the roller;

the weight member is connected to one end of the rope;

the slide block is mounted to the slide assembly, and is connected to the other end of the rope; and the pressing wheel is mounted to the slide block.

4. The feeding device as claimed in claim 1, wherein:

the transmission mechanism comprises a driver, a driving shaft, and a driving wheel;

the driver is mounted to the second column; and one end of the driving shaft is connected to the driver, and the other end of the driving shaft passes through the driving wheel.

5. The feeding device as claimed in claim 4, wherein:

the electronic control box slows the feeder assembly down to reduce a transferring speed of the carrier tape when the feeder assembly is moved away from the inductor; and the electronic control box speeds the feeder assembly up to increase a transferring speed of the carrier tape when the feeder assembly is moved toward the inductor.

6. The feeding device as claimed in claim 4, wherein the transmission mechanism further comprises a feeding wheel; and the feeding wheel is mounted under the driver to receive the carrier tape transferred by the driver.

7. The feeding device as claimed in claim 6, wherein the feeding device further comprises a saving assembly, the saving assembly is mounted adjacent to the feeding wheel under the feeder assembly.

8. The feeding device as claimed in claim 7, wherein the saving assembly comprises a plurality of saving wheels, the saving wheels are configured to receive the carrier tape from the feeding wheel and transfer the carrier tape to the feeder assembly.

9. The feeding device as claimed in claim 8, wherein the slide assembly comprises a gear, a guide rail, a connecting rope, a weight member, and a slide block.

10. The feeding device as claimed in claim 9, wherein:

the gear is mounted to one end of the third column;

the guide rail is mounted to the third column under the gear;

the connecting rope revolves the gear; and the slide block is connected to one end of the connecting rope, and mounted to the guide rail.

11. The feeding device as claimed in claim 9, wherein the feeder assembly is mounted above the saving assembly, and comprises a plurality of feeding wheels, the feeding wheels receives the carrier tape from the saving wheels.

12. The feeding device as claimed in claim 1, wherein the feeding device further comprises a discharging mechanism, the discharging mechanism is mounted to the fourth column.

* * * * *